US008382643B2

(12) United States Patent
Loveday

(10) Patent No.: US 8,382,643 B2
(45) Date of Patent: Feb. 26, 2013

(54) FACE LIFT EXERCISE DEVICE

(76) Inventor: Margaret Darlene Loveday, Las Vegas, NV (US)

( * ) Notice: Subject to any disclaimer, the term of this patent is extended or adjusted under 35 U.S.C. 154(b) by 39 days.

(21) Appl. No.: 13/098,469

(22) Filed: Jun. 4, 2011

(65) Prior Publication Data

US 2011/0230310 A1 Sep. 22, 2011

Related U.S. Application Data

(63) Continuation of application No. 12/532,439, filed as application No. PCT/US2008/058157 on Mar. 25, 2008, now Pat. No. 7,955,221.

(60) Provisional application No. 60/920,207, filed on Mar. 26, 2007.

(51) Int. Cl.
*A63B 21/00* (2006.01)

(52) U.S. Cl. ..... 482/11; 35/41

(58) Field of Classification Search ..... 2/206, 200; 35/41, 44; 482/11
See application file for complete search history.

(56) References Cited

U.S. PATENT DOCUMENTS

| | | | | |
|---|---|---|---|---|
| 3,118,667 | A | 1/1964 | Barons | |
| 3,286,576 | A | 11/1966 | West | |
| 3,386,732 | A | 6/1968 | Robins | |
| 3,407,809 | A | 10/1968 | Ross | |
| 3,813,096 | A | 5/1974 | Welch | |
| 3,924,850 | A | 12/1975 | Robertson | |
| 4,196,902 | A | 4/1980 | Borriello | |
| 4,744,556 | A | 5/1988 | Shaffer | |
| 4,864,663 | A * | 9/1989 | Horan | 2/206 |
| 5,293,880 | A | 3/1994 | Levitt | |
| 5,431,610 | A | 7/1995 | Miller | |
| 5,806,088 | A | 9/1998 | Zide et al. | |
| 5,963,295 | A | 10/1999 | Pernicka | |
| 6,406,404 | B1 | 6/2002 | Chu | |
| 2006/0201520 | A1 | 9/2006 | Christensen | |

FOREIGN PATENT DOCUMENTS

| | | | |
|---|---|---|---|
| WO | 97-18013 | A | 5/1997 |
| WO | 98-51377 | A | 11/1998 |

* cited by examiner

*Primary Examiner* — Jerome W Donnelly
(74) *Attorney, Agent, or Firm* — Andover Patents, LLC; Daniel N. Beinart

(57) ABSTRACT

A facial exercise device includes a handle, ring, tongue arm and flexible cheek arms. The device is inserted into a person's mouth and the person's cheeks are tightened against the resistance provided by the flexible cheek arms. An optional eyepiece includes connected flexible right and left eye portions and two or more protrusions extending outwardly.

2 Claims, 8 Drawing Sheets

FACE LIFT EXERCISE DEVICE

CROSS-REFERENCED TO RELATED APPLICATIONS

This non-provisional application is a continuation application of U.S. Non-Provisional application Ser. No. 12/532,439 filed Sep. 22, 2009 and entitled "Face Lift Exercise Device", the entire contents of which are hereby incorporated by reference, as if fully set forth herein.

This non-provisional application claims the benefit of priority to the U.S. Provisional Application Ser. No. 60/209,207 filed Mar. 26, 2007 and entitled "Face Lift Exercise Device", the entire contents of which are hereby incorporated by reference, as if fully set forth herein.

FIELD OF THE INVENTION

The present invention relates generally to the field of facial exercise apparatuses and devices, medical and non-medical, used for exercising toning and rejuvenating the muscles and nerves of the face, chin and neck, and their corresponding methods of use.

BACKGROUND OF THE INVENTION

Many effective, useful exercise devices and methods exist for promoting the physical fitness of the body. Our efforts to promote health, longevity, strength through exercise can result in a more vibrant youthful appearance, mainly due to the increased circulation and muscle tone of the intended body part(s). The present inventor has found a great deficiency in existing facial exercise apparatuses, and/or their suggested methods of use, in that most available units are inconvenient, difficult, awkward, painful and even somewhat dangerous at times to the user as well as ineffective.

Most facial exercise apparatuses available today typically contain somewhat precariously attached, internal, external stationary, and/or moving parts such as bolts, belts, bands, screws, springs, magnets, electrodes, machinery, batteries, padding, weights and/or combinations thereof, etc. Many of these attached parts degrade quickly requiring that the user reorder or reapply them on a continuing basis at home; without the reorders these apparatuses often become obsolete and useless.

In addition, the method of use of these facial exercise apparatuses often require that extreme pressure or tension be applied to these same precariously attached parts, increasing the risk of their popping, thus pinching or injuring the delicate facial tissues/muscles, teeth, or eyes when these precariously attached parts are applied even when used according to manufacturers suggestions. If such dislodgement occurs while an exercise device is in use either intra-orally or near the eye area, it can cause soft tissue damage, dental problems, choking, blindness, and other hazards to the person's health and well-being. In addition, the corrosion and/or dislodgement of parts of a facial exercise apparatus reduces the usable life of such a product.

Many existing facial exercise apparatuses require mastication and/or repetitive motion of the devices. These methods of use alone may damage the soft facial tissue through friction or excessive rubbing and the like. Some manufacturers even warn users of possible tooth and dental work breakage. Some methods of use will cause accelerated degradation of the facial exercise apparatuses requiring additional and continual repurchasing. Some facial exercise devices have been known to cause nerve damage; one even caused retinal damage. In addition, some facial exercise devices require batteries and/or electrical power.

Other methods of improving facial appearance include facial plastic surgery, and topical treatments and ointments, all of which can have undesirable side effects.

Therefore a need exists for a safe, compact, facial exercise apparatus or device with a more simplified and safer method of use. More particularly, there is a need for a facial exercise device that does not contain parts that can corrode and/or dislodge, parts that need to be renewed and replaced frequently, and that does not require electrical current.

A device constructed according to the principles of the present invention addresses these deficiencies.

BRIEF SUMMARY OF THE INVENTION

In accordance with principles of the present invention, an embodiment of a facial exercise device includes a mouthpiece which includes an optional handle, an annular ring, a tongue arm and at least two flexible cheek arms. An alternate embodiment of a facial exercise device additionally includes an eyepiece which includes connected right and left eye portions and two or more protrusions extending outwardly in varying directions and lengths from each of the eye portions. The eyepiece is optionally connected by one or more of the protrusions to the handle of the mouthpiece.

DETAILED DESCRIPTION OF THE INVENTION

Figure 1:
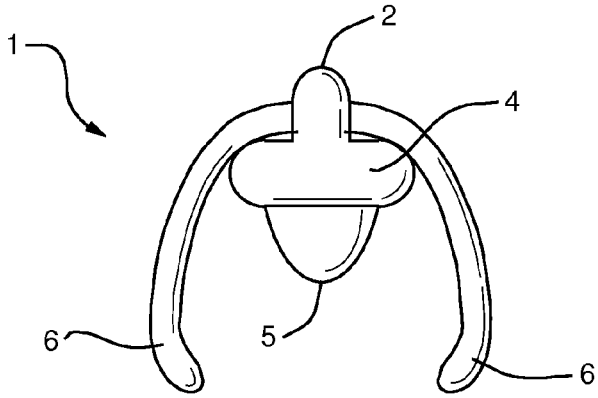
FIGS. 1 and 2 depict top views of an embodiment of a facial exercise device in accordance with principles of the present invention.
Figure 2:
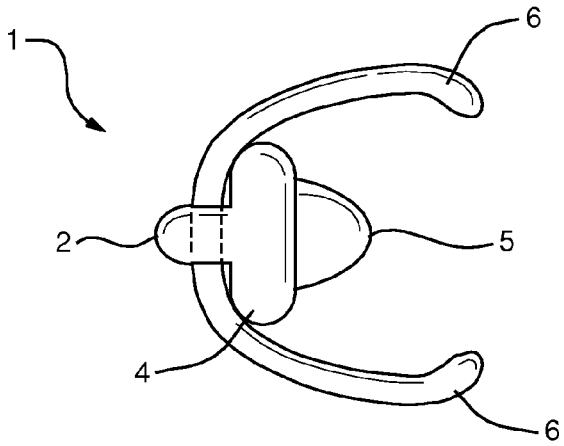
Figure 3:
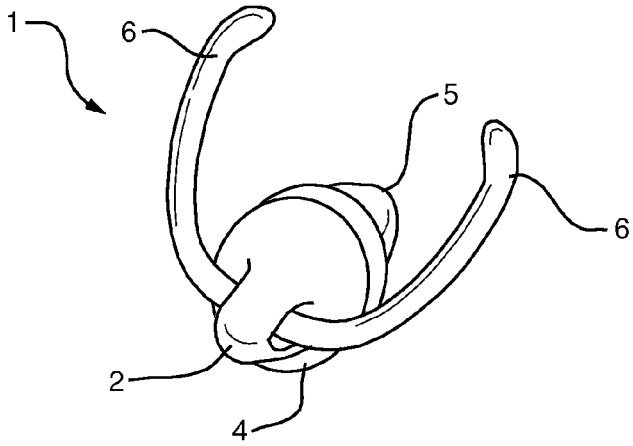
FIG. 3 depicts a perspective view of an embodiment of a facial exercise device in accordance with principles of the present invention.

FIGS. 1 and 2 depict top views of an embodiment of a facial exercise device in accordance with principles of the present invention. As depicted in FIG. 1, the facial exercise device 1 comprises an optional handle 2 for inserting and holding the facial exercise device, an annular ring 4, a tongue arm 5 and two flexible cheek arms 6. In one embodiment, the handle has a channel and the cheek arms pass through the channel and are rotatable within the channel. The tongue arm 5 is typically approximately half the length of an average person's tongue. The handle 2, if present, extends from the front portion of the annular ring 4 and the tongue arm 5 extends from the back portion of the annular ring 4. The depicted embodiment has two opposing flexible cheek arms 6, typically of approximately matching length, each of which extend outward from opposing sides of the handle 2. In an alternate embodiment, the flexible cheek arms 6 extend outward from each side of the tongue arm 5. A second alternate embodiment includes more than two flexible cheek arms 6 (not shown), each of which extend outward from the tongue arm 5. A third alternate embodiment includes more than two flexible cheek arms 6, each of which extend outward from the annular ring 4.

Figure 9:
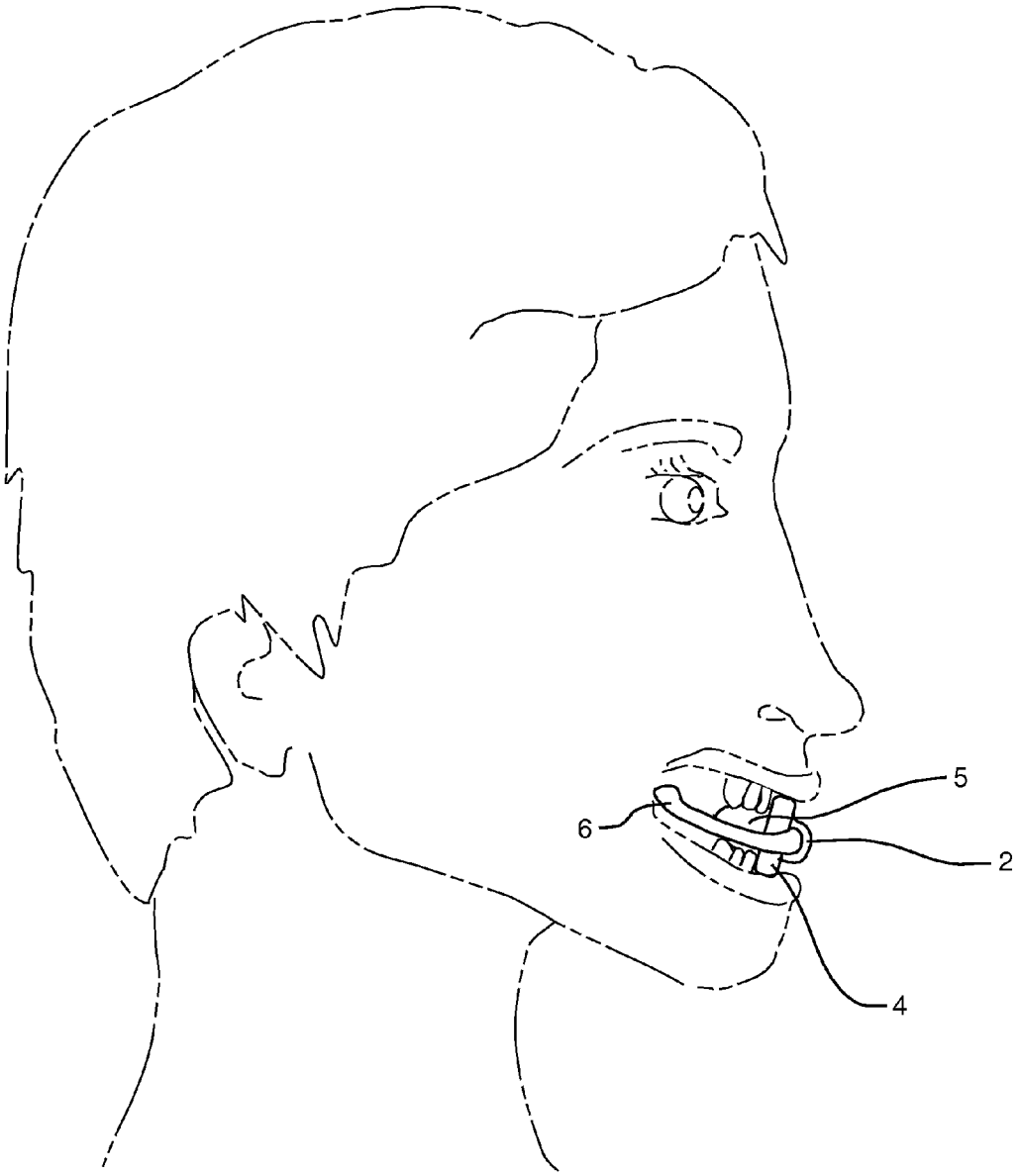
FIG. 9 illustrates the mouthpiece of FIGS. 1-3 in use by a person.

The flexible cheek arms 6 exert outward pressure along the entire length of the inner cheeks starting near the inner corners of the mouth, gradually narrowing on the inner cheeks side and ending before they meet the back molars. The flexible cheek arms 6 are typically thin enough in circumference and or thickness to enable them to move in and out between the top and bottom teeth when the teeth are in a slightly open position. This design allows the flexible cheek arms 6 to push the inner gums outwardly and horizontally at approximately the mid-point of the inner cheeks, halfway between the upper and lower gums, aligning the flexible cheek arms 6 with the opening between the top and bottom teeth when compressed (as shown in FIG. 9).

The facial exercise device 1 thus addresses the problem that other facial exercise devices exhibit of containing parts that can corrode and dislodge during use. Furthermore, the facial exercise device 1 is light-weight and compact and therefore convenient for travel or shipping and ease of use.

To use the facial exercise device 1, a person holds the handle 2, typically with index finger and thumb, and inserts the device 1 into his or her mouth, positioned so that the annular ring 4 is placed between the lips, in front of the two front teeth, allowing the teeth to rest on the wider section of the tongue arm with the handle 2 protruding from the mouth. FIG. 9 illustrates the facial exercise device 1 inserted into position within a person's mouth.

Positioning the device 1 in this way keeps the lips from over-pursing while using the device. With the facial exercise device 1 held in this position in the mouth, the flexible cheek arms 6 exert outward forces against the inner cheeks. The person tightens the cheeks against the forces provided by the flexible cheek arms 6, squeezing and resting the cheeks repetitively, and at the same time presses his or her tongue against the tongue arm 5 which firms the muscles of the chin and neck. For optimal use, the person does not move the jaw, i.e., no chewing action, mastication or gritting of the teeth is required or desirable.

When used in the manner described above, the facial exercise device 1 exercises and tones the person's cheeks and lips while increasing circulation to the nerves muscles and tissues of the surrounding chin and neck areas.

Figure 4:
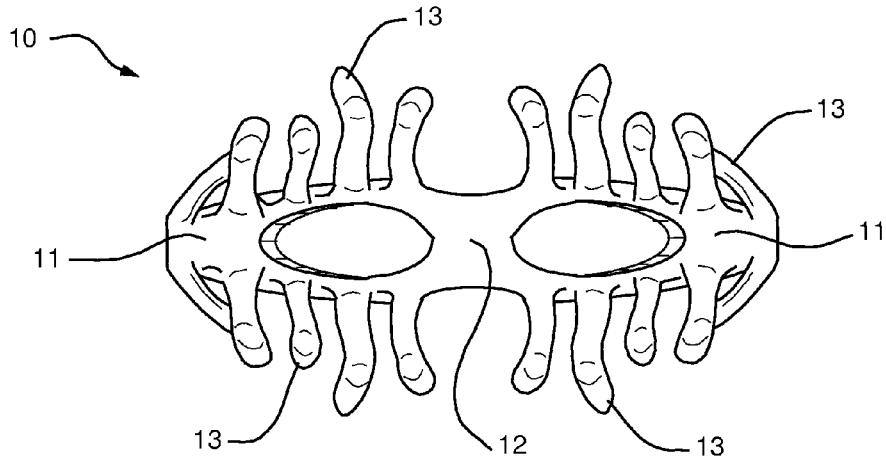
FIG. 4 depicts a front view of an embodiment of an eyepiece of a facial exercise device in accordance with principles of the present invention.

FIG. 4 depicts a front view of an embodiment of an eyepiece 10 of a facial exercise device in accordance with principles of the present invention. As depicted in FIG. 4, the eyepiece 10 comprises flexible right and left eye portions 11 and a connecting portion 12 that connects the right and left eye portions 11. An optional plurality of protrusions 13 extend from the right and left eye portions 11. These protrusions 13 exert tension and pressure against the facial muscles causing resistance in order to isolate the muscles of the eye lids, surrounding eye area, forehead, and upper cheek area. The eyepiece 10 is optionally connected (not shown) by one or more of the protrusions 13 to the handle 2. In one embodiment, the handle has a channel and the cheek arms pass through the channel and are rotatable within the channel.

The eyepiece 10 is used by holding the eyepiece 10 over the eyes and pressing against the face. When a person uses the facial exercise device 1 together with the eyepiece 10, the alternating relaxing and contracting of the eye, cheek, forehead and lip muscles engage virtually all of the horizontal and vertical muscle groups of the forehead, eye, cheek, chin and neck areas.

Figure 5:
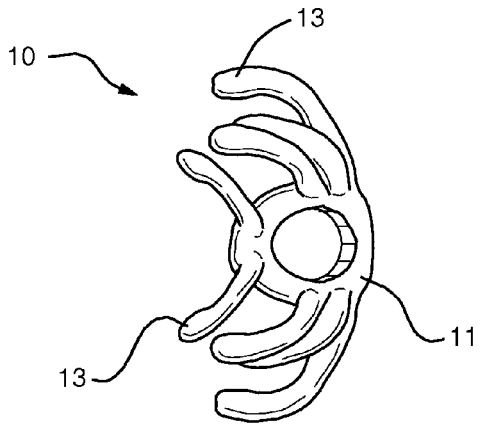
FIG. 5 depicts a side view of the eyepiece of FIG. 4 in accordance with principles of the present invention.
Figure 6:
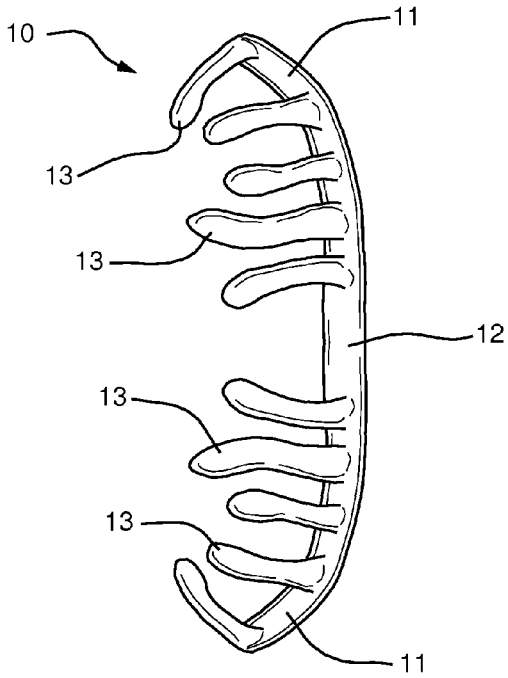
FIG. 6 depicts a top view of the eyepiece of FIG. 4 in accordance with principles of the present invention.
Figure 7:
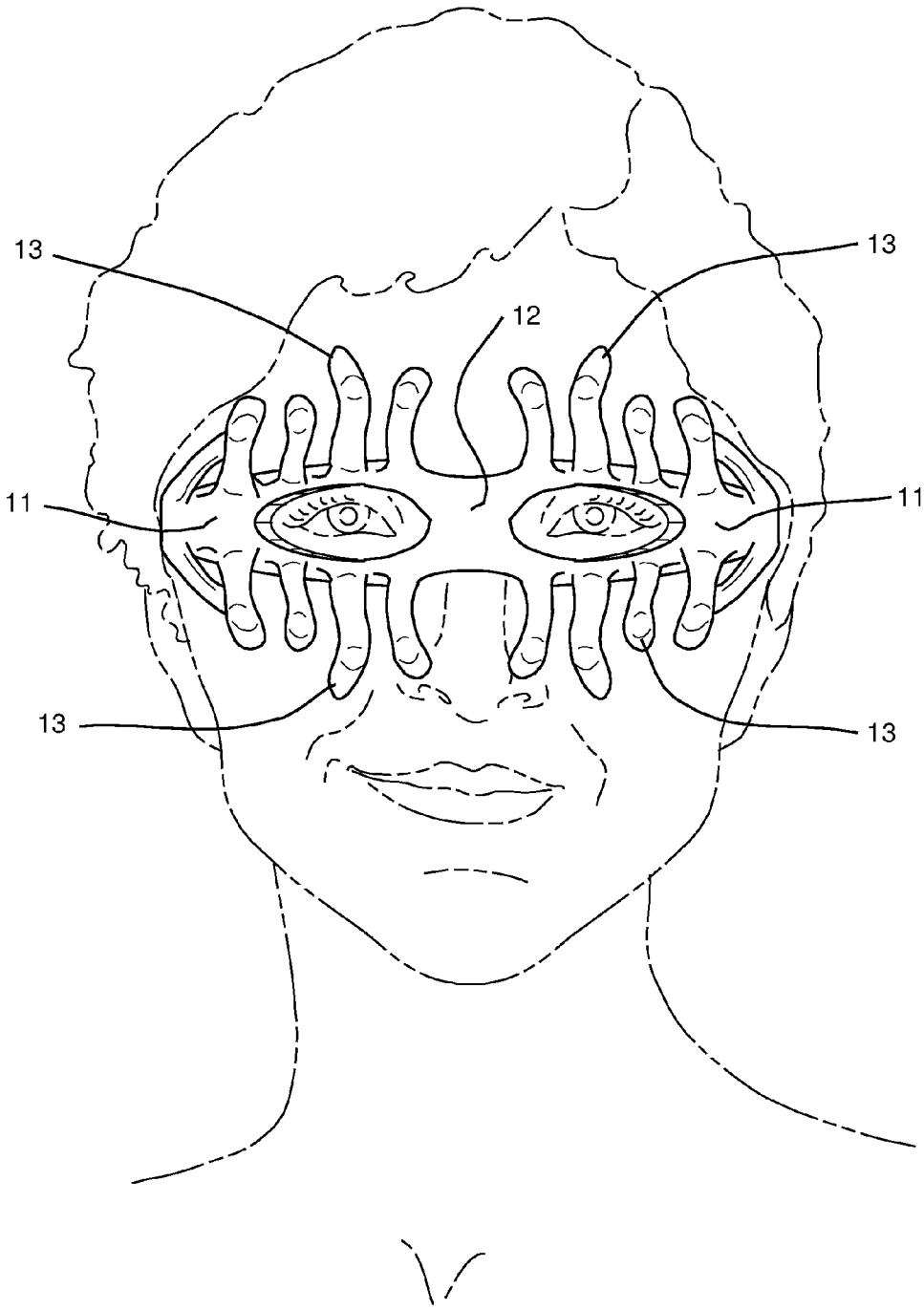
FIGS. 7 and 8 illustrate the eyepiece of FIGS. 4-6 in use by a person.
Figure 8:
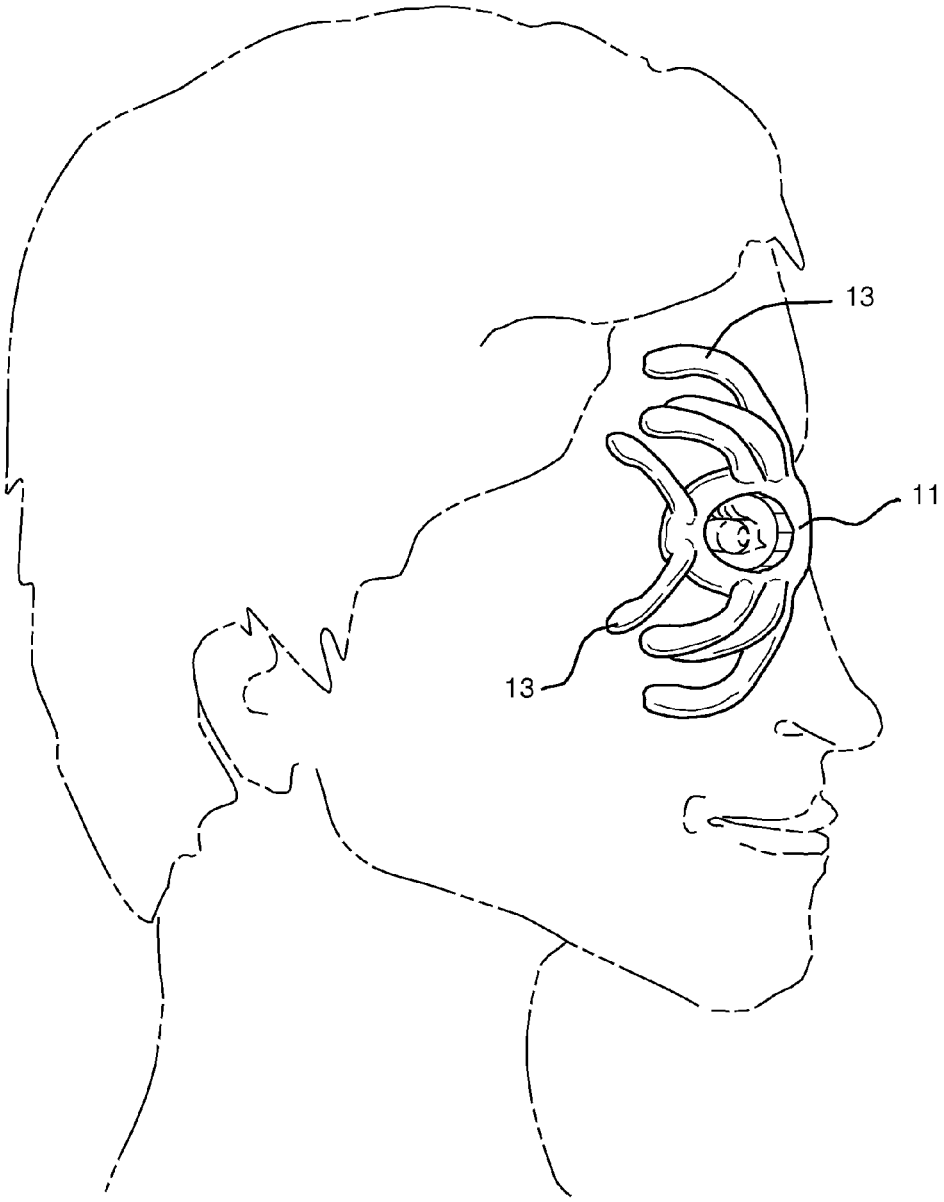
Figure 10:
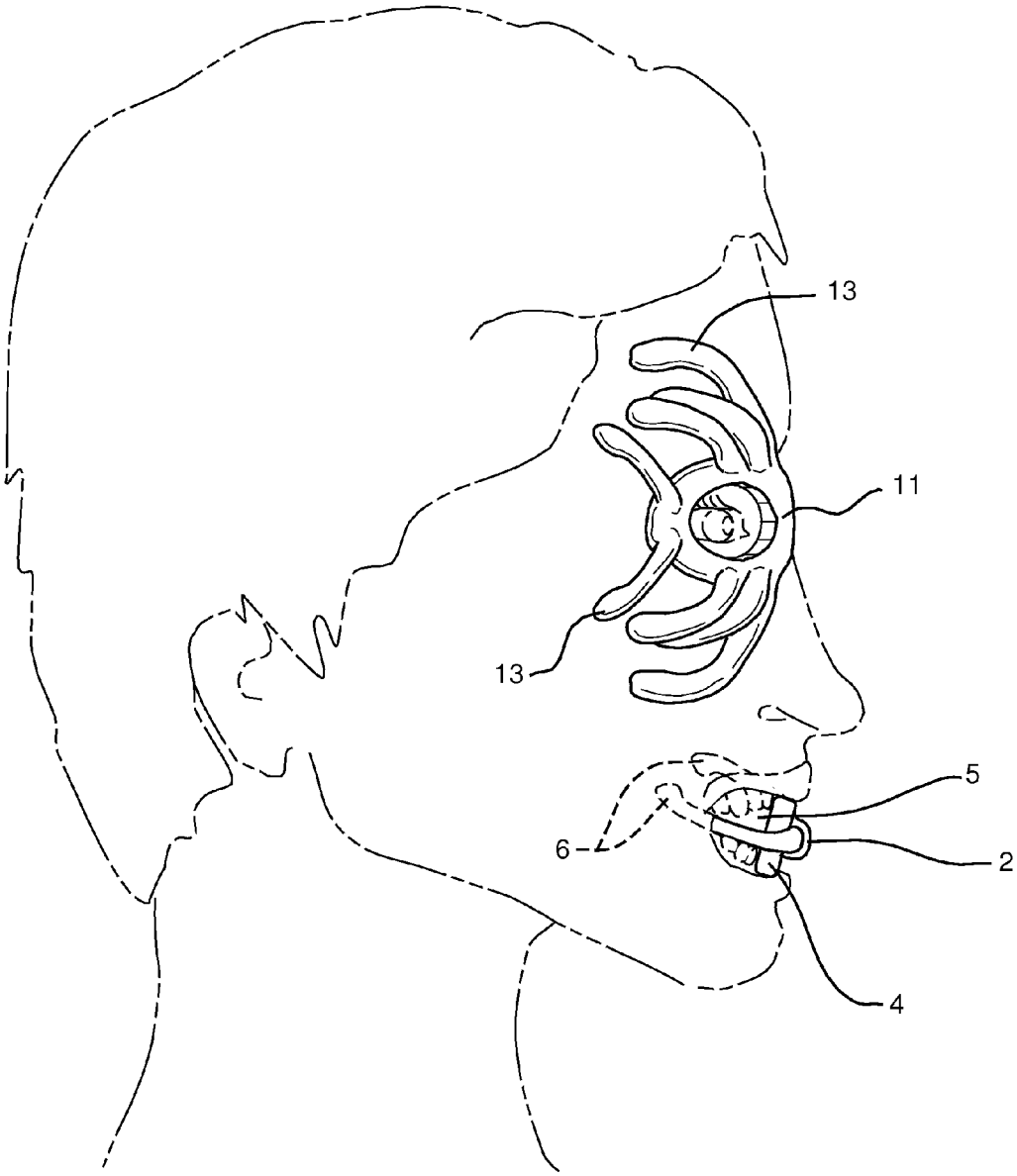
FIG. 10 illustrates the mouthpiece of FIGS. 1-3 and the eyepiece of FIGS. 4-6 in use by a person.

FIGS. 5 and 6 depict a side view and side view, respectively, of the eyepiece 10 of FIG. 4 in accordance with principles of the present invention. FIGS. 7 and 8 illustrate the eyepiece 10 of FIGS. 4-6 in use by a person. FIG. 10 illustrates the facial exercise device 1 and an unconnected eyepiece 10 in use by a person.

Figure 11C:
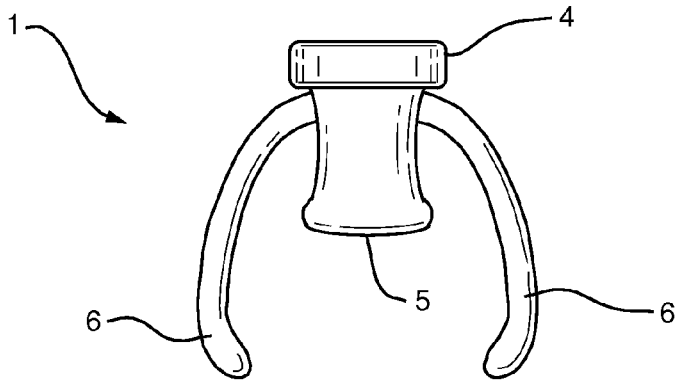
FIGS. 11(*a*), 11(*b*), and 11(*c*) depict views of alternate embodiments of a mouthpiece of a facial exercise device in accordance with principles of the present invention.
Figure 11B:
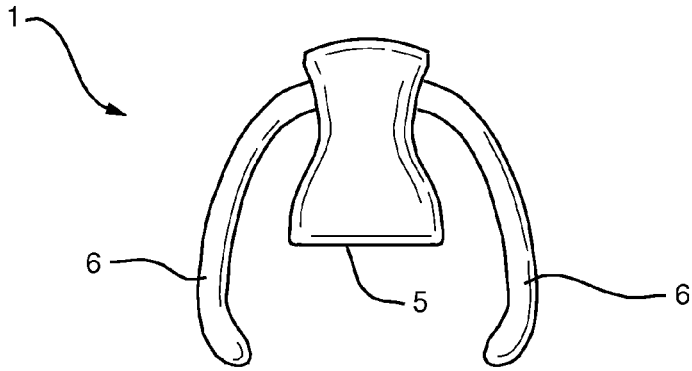
Figure 11C:
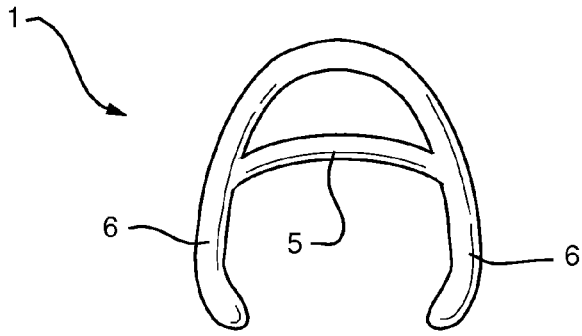

FIGS. 11(*a*), 11(*b*), and 11(*c*) depict views of alternate embodiments of a facial exercise device 1. The facial exercise devices 1 depicted in FIGS. 11(*a*) and 11(*b*) do not include a handle, and the tongue arm 5 is slightly flared horizontally, closest to the throat side. The facial exercise device 1 depicted in FIG. 11(*c*) does not include a handle or an annular ring; the flexible cheek arms 6 and tongue arm 6 are substantially formed as a single piece.

Figure 12A:
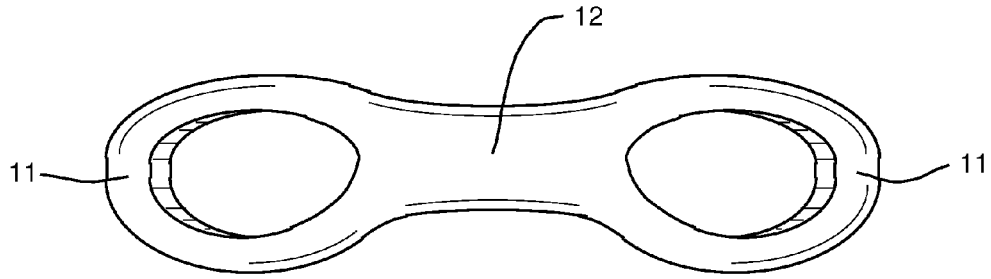
FIGS. 12(*a*), 12(*b*), and 12(*c*) depict views of an alternate embodiment of an eyepiece of a facial exercise device in accordance with principles of the present invention.
Figure 12B:
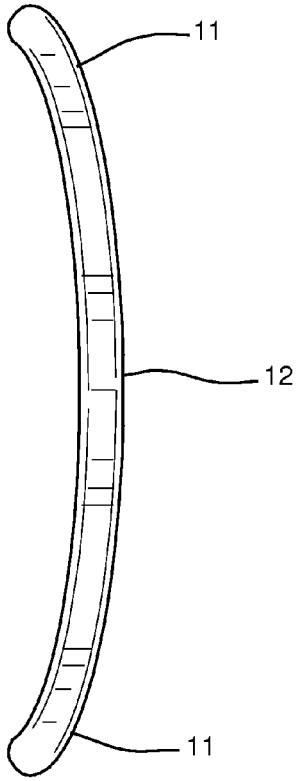
Figure 12C:
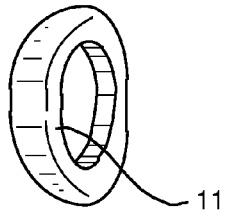

FIGS. 12(*a*), 12(*b*), and 12(*c*) depict front, top, and side views, respectively, of an alternate embodiment of an eyepiece of a facial exercise device that do not include the pluralities of protrusions.

All of the depicted elements of the facial exercise device 1 and 10 are formed or constructed of suitable substances such as non-toxic rubber or vinyl or surgical steel or other suitable metals or materials and contain virtually no precariously attached moving or stationary parts that could corrode quickly and dislodge while in use. In addition, the substance used to form or construct the flexible cheek arms 6 and protrusions 13 is flexible, thus providing tension against a person's inner cheeks or eye area when the device 1 is inserted in the person's mouth, or pressed against the eye/forehead/upper cheek area.

While a particular form and use of the present invention has been described above, the invention is not limited to the specific arrangement of parts or manner of use described.

One skilled in the art understands that modifications to the construction and use of the present system may be made without departing from the scope of the invention.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

What is claimed is:

1. A facial exercise device, the device comprising:

an annular ring having a front portion and a back portion;

a handle extending from the front portion of the annular ring, said handle having a channel and an axis;

a tongue arm extending from the back portion of the annular ring; and at least two flexible cheek arms extending from the handle in directions relatively perpendicular to the axis of the handle, the flexible cheek arms passing through the channel of the handle wherein the cheek arms are rotatable within the channel.

2. The facial exercise device of claim 1, wherein the flexible cheek arms are of substantially equal length.

* * * * *